US008662848B2

(12) United States Patent
Tran et al.

(10) Patent No.: US 8,662,848 B2
(45) Date of Patent: Mar. 4, 2014

(54) WATER IMPELLER

(71) Applicant: Gulfstream Inc., Cambridge (CA)

(72) Inventors: Minh Sang Tran, Cambridge (CA); Christopher Alexander, Cambridge (CA)

(73) Assignee: Gulfstream Inc., Cambridge, Ontario (CA)

( * ) Notice: Subject to any disclaimer, the term of this patent is extended or adjusted under 35 U.S.C. 154(b) by 0 days.

(21) Appl. No.: 13/748,092

(22) Filed: Jan. 23, 2013

(65) Prior Publication Data

US 2013/0136620 A1 May 30, 2013

Related U.S. Application Data

(62) Division of application No. 12/483,850, filed on Jun. 12, 2009, now Pat. No. 8,366,418.

(51) Int. Cl.
*F01D 5/14* (2006.01)

(52) U.S. Cl.
USPC ..... 416/183; 417/420; 417/423.1

(58) Field of Classification Search
USPC ..... 417/420, 423.1, 423.3, 423.12, 423.14, 417/423.15; 416/183, 235, 236 R, 236 A
See application file for complete search history.

(56) References Cited

U.S. PATENT DOCUMENTS

| | | | | |
|---|---|---|---|---|
| 4,984,972 | A | 1/1991 | Clausen et al. | |
| 5,017,103 | A * | 5/1991 | Dahl | 417/420 |
| 5,399,074 | A | 3/1995 | Nose et al. | |
| 5,458,459 | A | 10/1995 | Hubbard et al. | |
| 6,483,264 | B1 | 11/2002 | Shafer et al. | |
| 6,623,475 | B1 * | 9/2003 | Siess | 604/891.1 |
| 7,393,188 | B2 | 7/2008 | Lawyer et al. | |
| 8,366,418 | B2 | 2/2013 | Tran et al. | |
| 2003/0094519 | A1 * | 5/2003 | van der Steur | 239/690 |
| 2003/0233021 | A1 | 12/2003 | Nose et al. | |
| 2004/0018104 | A1 | 1/2004 | Watkins | |
| 2006/0210412 | A1 | 9/2006 | Lawyer | |
| 2007/0231135 | A1 | 10/2007 | Wampler et al. | |
| 2008/0163756 | A1 * | 7/2008 | Stettes | 99/280 |
| 2011/0223047 | A1 | 9/2011 | Tran et al. | |
| 2011/0253236 | A1 | 10/2011 | Le et al. | |

FOREIGN PATENT DOCUMENTS

CA 2706306 A1 12/2010

* cited by examiner

*Primary Examiner* — Peter J Bertheaud
*Assistant Examiner* — Dominick L Plakkoottam
(74) *Attorney, Agent, or Firm* — Jones Walker LLP

(57) ABSTRACT

The invention is a magnetically driven pump with a floating impeller and driven magnet, and the invention includes an impeller surface having geometric figures acting as the pumping bodies.

14 Claims, 12 Drawing Sheets

WATER IMPELLER

PRIORITY CLAIM

This application is a divisional of U.S. application Ser. No. 12/483,850, filed on Jun. 12, 2009, and hereby claims priority thereto and which application is incorporated by reference in its entirety.

FIELD OF THE INVENTION

The present invention relates to centrifugal pumps, more particularly, the housing design for a magnetically driven centrifugal pump, and to a novel impeller design.

BACKGROUND OF THE INVENTION

Centrifugal pumps use an impeller and volute to create the partial vacuum and discharge pressure to move water through the pump, A centrifugal pump works by the conversion of the rotational kinetic energy, typically from an electric motor or turbine, to an increased static fluid pressure. An impeller is a rotating disk coupled to the motor shaft within the pump casing that produces centrifugal force with a set of vanes. A volute is the stationary housing in which the impeller rotates that collects and discharges fluid entering the pump. Impellers generally are shaft driven, have raised radially directed vanes or fins 1 that radiate away form the eye or center 3 of the impeller, and channels 2 are formed between the vanes. See FIGS. 10 and 11. As the impeller turns, centrifugal force created by the rotating vanes pushes fluid away from the eye 3 where pressure is lowest, to the vane tips where the pressure is highest. Water is directed into the pump via input ports, generally positioned near the impeller eye or center 3, and fluid flows within the pump is generally in the channels 2 between the vanes 1. The pressurized fluid is directed by the volute to the discharge or outlet location of the pump.

Small pump applications, for instance for use in footspas or aquariums, generally are either propeller driven axial pumps, or centrifugal impeller type pumps. Smaller pumps are generally more inefficient, creating heat that must be dissipated. A novel impeller design and housing design are presented that allows for both heat dissipation and smooth flow characteristics suitable for a small pump.

SUMMARY OF THE INVENTION

The invention is a magnetically driven pump with a floating impeller and impeller surface having geometric figures acting as the pumping bodies

BRIEF DESCRIPTION OF THE DRAWINGS

FIG. 8 is a cross section through one embodiment of the magnet retainer housing

Figure 3:
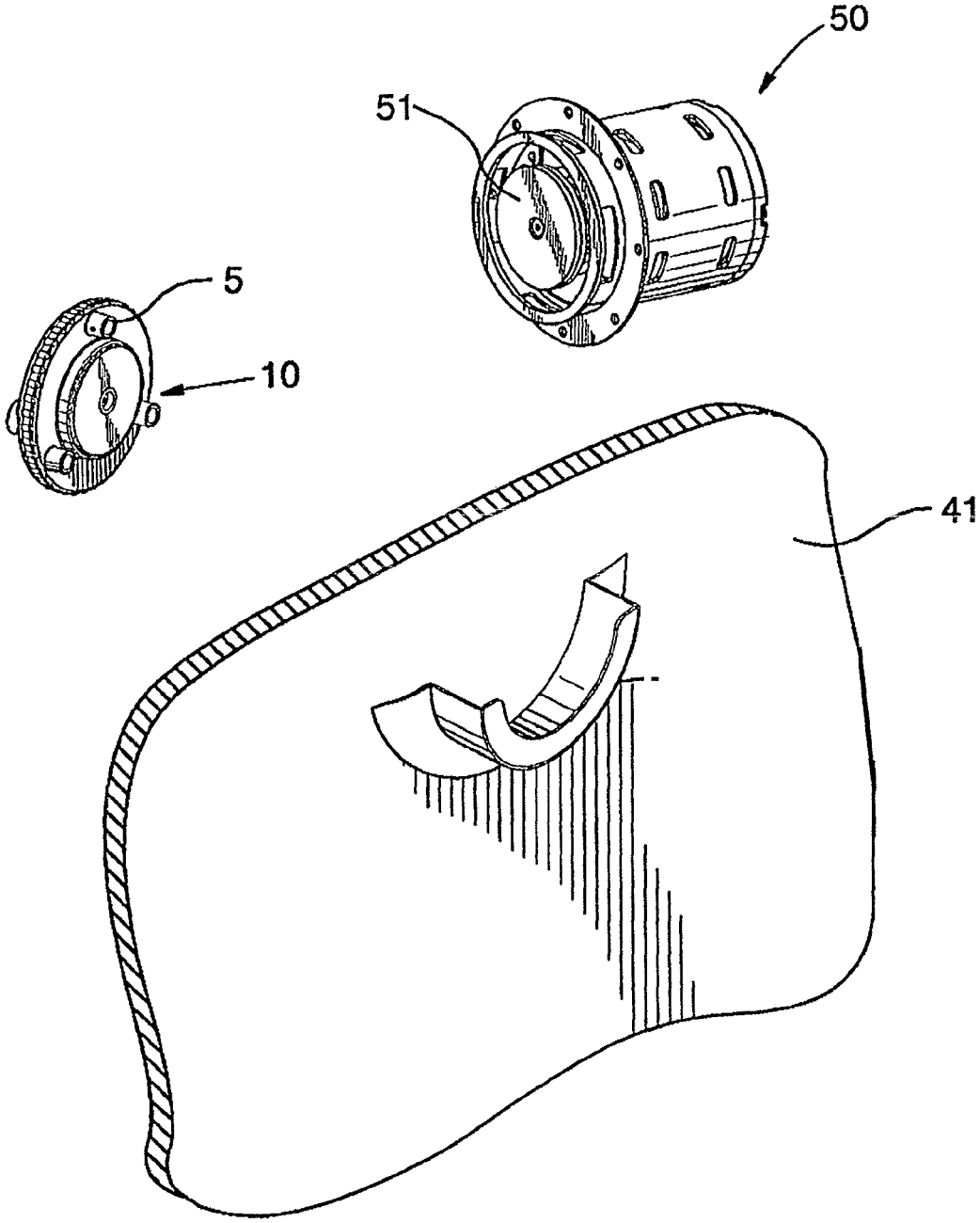
FIG. 3 is perspective view of a magnetically driven pump system

DETAILED DESCRIPTION OF THE INVENTION:

As shown in FIG. 3, the pump system is a magnetically driven pump, such as described in U.S. Pat. No. 7,393,188 (hereby incorporated by reference). The magnetically driven pump system is quiet, efficient, and has a small foot print in the application interior. The magnetically driven pump system includes a driving motor 50 which turns a motor shaft and a driving motor magnet body 51 attached to the motor shaft. The motor magnet 51 is positioned adjacent to the exterior wall 41 of the application enclosure. Adjacent to the motor and driving magnet on the interior wall of the application is the pump, including the pump body 10.

Figure 4:
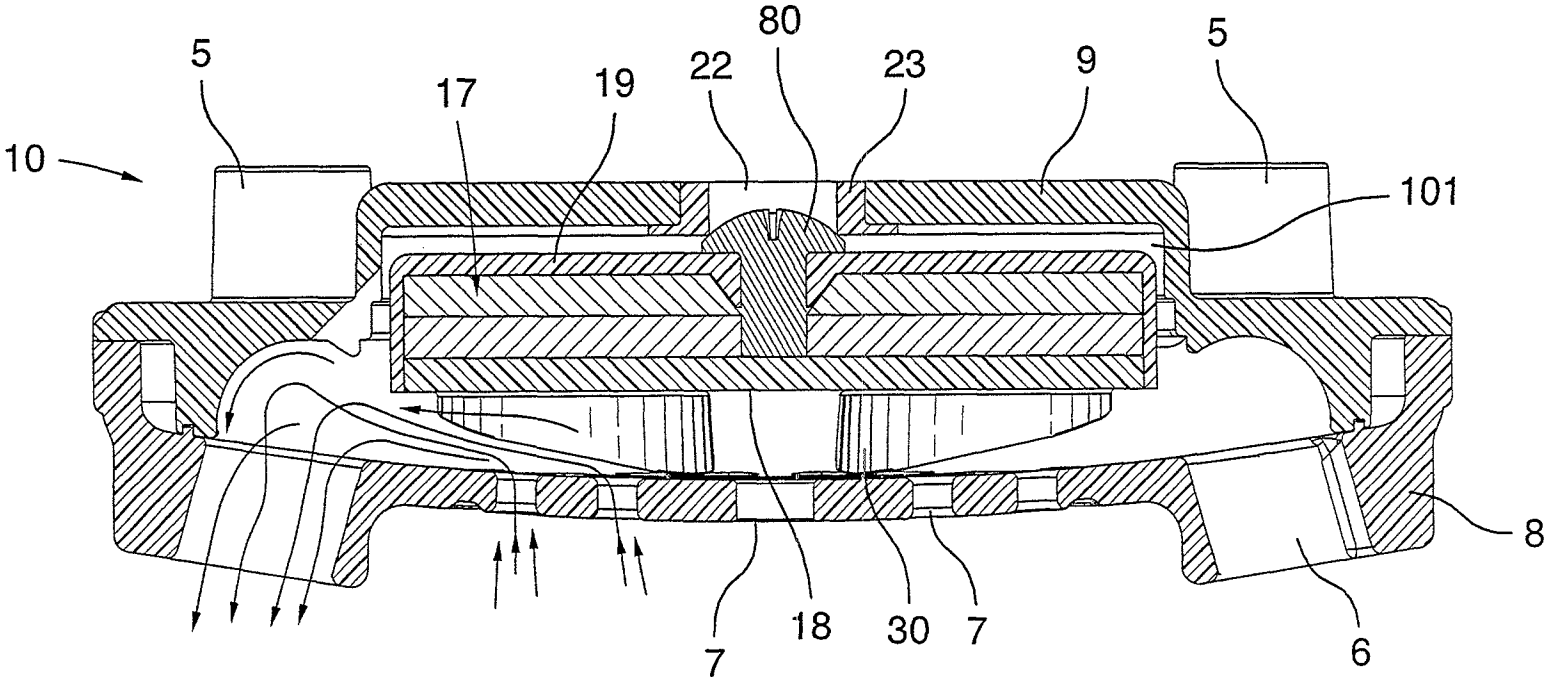
FIG. 4 is a cross section through one embodiment of the pump body.
Figure 5:
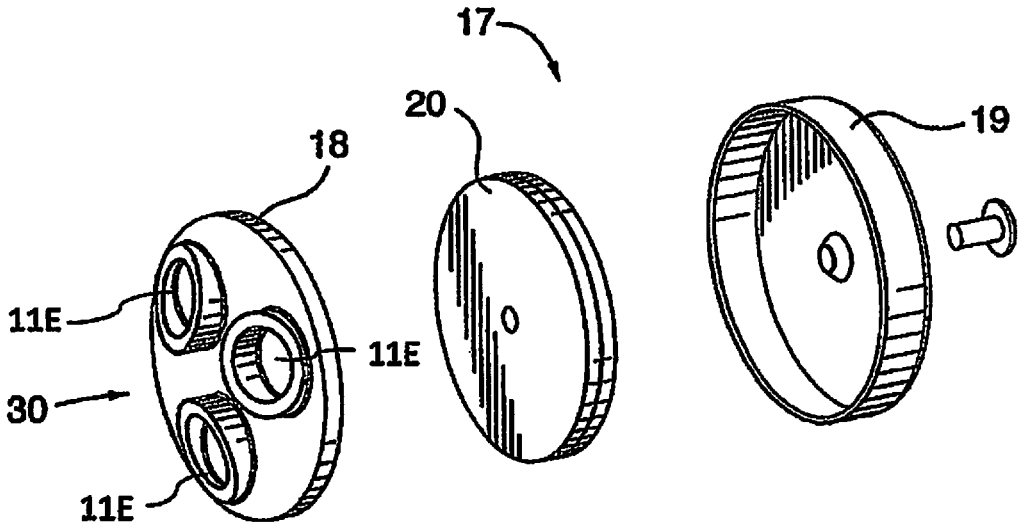
FIG. 5 is a front exploded view of the magnet housing of FIG. 1
Figure 6:
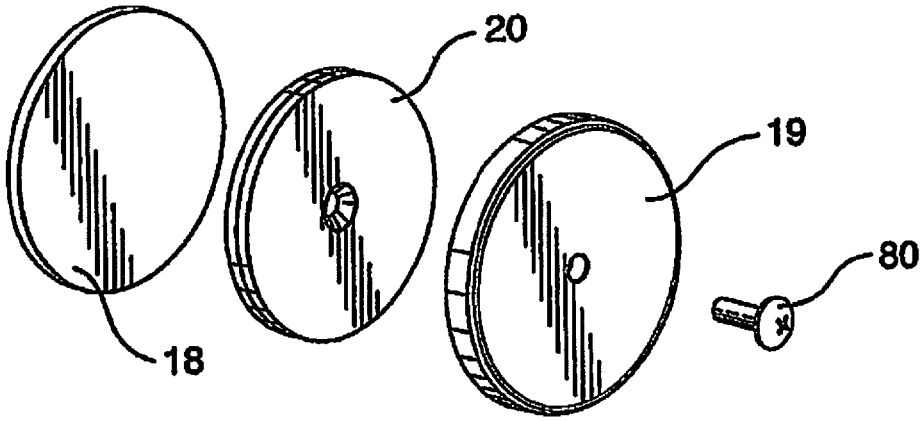
FIG. 6 is a rear exploded view of the magnet hosing of FIG. 1
Figure 7A:
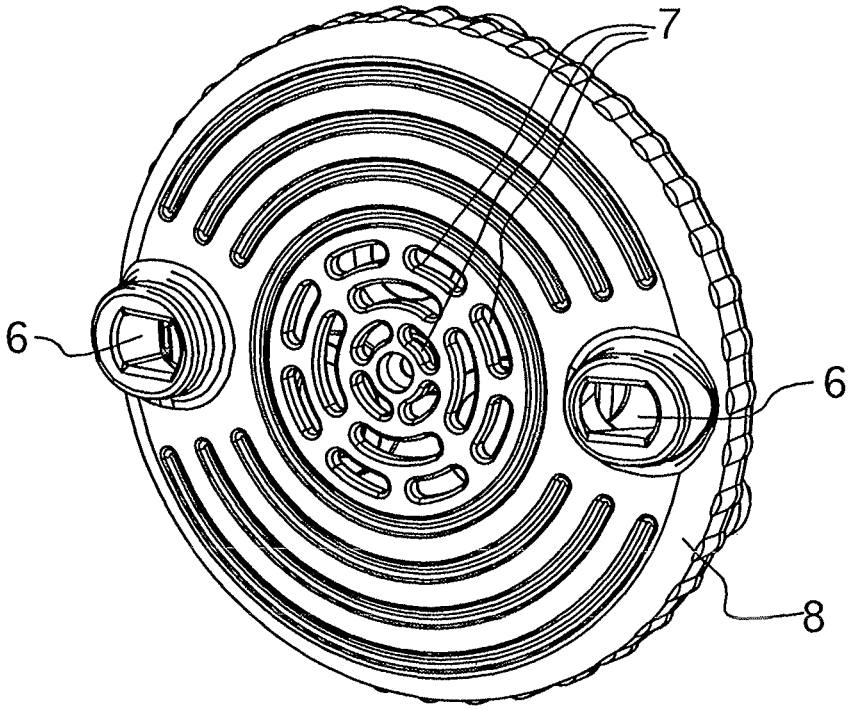
FIG. 7A is a front perspective view of one embodiment of the pump body

FIG. 4 shows an embodiment of the pump body 10. Shown are the pump front 8 and rear 9 sections, creating a pumping chamber 101 therebetween. In a pump suitable for a spa environment, it is preferred that the pump inlet ports 7 and outlet ports 6 be located on the pump front portion 8 (see FIG. 7A). For other applications, the discharge port(s) may be located elsewhere, with pump output flow directed by a suitably located discharge diffuser or volute, for instance, for side discharge.

Located in the chamber 101 is a magnet retainer housing 17, comprising a retainer bottom portion 19, and a retainer top portion 18. Impeller 30 is attached to the magnet retainer top portion 18, here shown as integrally molded into the top portion. The bottom and top retainer portions 19 and 18 couple together creating an interior space or volume there between. Located in this retainer interior space is the pump magnet 20. In this embodiment, the magnet 20 is firmly gripped in the interior of the magnet retainer housing 17 (there may be a snap body to snap the magnet in the magnet housing), so that rotation of the magnet 20 causes rotation of the impeller 30, creating a rotative body. The magnet retainer housing may be dispensed with if the impeller is directly attached to the magnet. The magnet retainer housing 17 (or the magnet and impeller if the housing is not used) floats in the interior 101 of the pump housing, as later described. The driven pump magnet 20 and driving motor magnets 51 are of sufficient strength to be magnetically coupled through the application wall. Hence, as the motor magnet rotates, by action of the motor, the pump magnet also rotates by the coupling of the motor magnet with the pump magnet, thereby rotating the impeller. To assist in coupling, each magnet may have multiple N and S domains, where opposite domains face each other—for instance, a "N" domain on the motor magnet that is on the surface facing the pump magnet will align with an "S" domain on the driven pump magnet on the surface of the pump magnet that faces the motor magnet. At least two domains per magnet are desired on opposing faces.

One novel figure of the pump is the means to support the rotative body (here the magnet retainer housing 17) in the pump body. The interior face of the rear portion 9 of the pump body 10 has a center cutout or depression 22, shown lined with a bushing 23 to reduce wear (see FIG. 4), forming a rotation support. This support 22 is centered on the impeller 30; that is, the axis of rotation of the impeller 30 aligns with the cutout or support 22 on the interior face of the bottom portion 9 of the pump body 10. The exterior bottom face of the rotative body, here the bottom portion 19 of the magnet retainer housing 17, is generally a flat surface. However, in the present embodiment, positioned on this face is a raised shaped rotation center 80 that aligns with the rotation support 22. As shown, the raised rotation center 80 is curved (here, the rotation center 22 is a curved bolt head, forming a portion of a hemisphere). The rotation center 80 has a diameter that is slightly larger than that of the diameter of rotation support 22 diameter. Hence, the rotative body's (magnet retainer housing 17) rear portion 19 is supported above the rear portion 19 of the pump body 10 (in one embodiment, about an ⅛ inch above the face) by the rotation center 80, supported in the rotation support 22. The magnet retainer housing 17, while supported by the housing is detached from the housing, thus the rotating body substantially floats in the interior of the pump body 10. When the rotation center 80 includes an opening allowing fluid flow, the rotative body will essentially hydroplane in the rotation support. The rotation center 80 is shaped to allow the magnet retainer housing 17 to pivot in the rotation support 22. Alternatively, the rotation support 22 may be a curved depression surface (such as hemispherical shape, or a truncated hemisphere), of larger diameter that the rotation center, with the rotation center being a cylinder or a curved surface but of sufficient length to allow the magnet retainer housing 17 to pivot in the interior 101 of the pump body 10 about the rotation center 80. Alternatively, the rotation support 22 may be a raised surface, with the rotation center being a depression or cutout in the magnetic retainer housing, with suitable diameters to allow the housing's axis of rotation to pivot about the rotation support 22. The ability of the rotative body, here the magnet retainer housing 17, to pivot about the rotation support 22 allows the driven pump magnet 20 to tilt or pivot its axis of rotation to better align with the axis of rotation of the driving pump magnet 51. The axis of rotation may be tilted or cocked (as measured from a perpendicular from the rear of the pump housing) by several degrees (0-5 degrees, with a upper range of at least 2-3 degrees). Hence, if the plane of rotation of the driven motor magnet 51 is slightly misaligned from that of the rear of the pump body 10 (i.e., not parallel), the rotative body (here the rotating magnet retainer housing 17) will pivot about the rotation support 22 until good magnetic coupling and alignment is achieved between the two magnets (or the edge of the magnet retainer housing 17 contacts the interior wall of the chamber 101).

Figure 12:
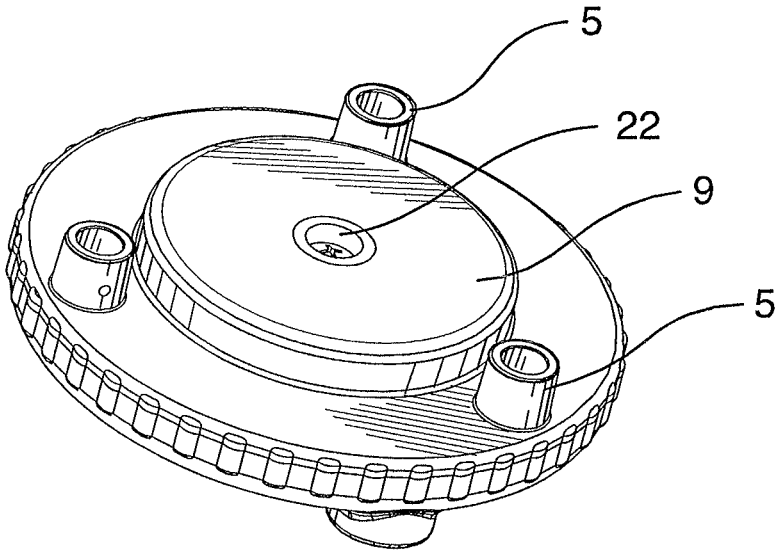
FIG. 12 is a perspective view of the rear of one embodiment of a pump impeller.

In the embodiment shown (see FIG. 4), the center cutout 22 forms a through opening in the pump body rear portion 9, allowing fluid communication through the center cutout opening 22. This configuration is preferred, as fluid will flow through the opening 22, reducing the friction caused by the rotation of the rotation support 80 in the center cutout 22. The magnet retainer housing floats in the interior chamber due to hydroplaning. Fluid transport through this opening 22 also removes heat, providing for longevity of the pump. If the center cutout 22 is a opening in the housing, the housing rear portion 9 should have standoffs 5 to support the rear portion 9 of the pump body 10 away from the application wall so the opening 22 is not blocked by contact with the application wall (see FIG. 12).

Figure 11:
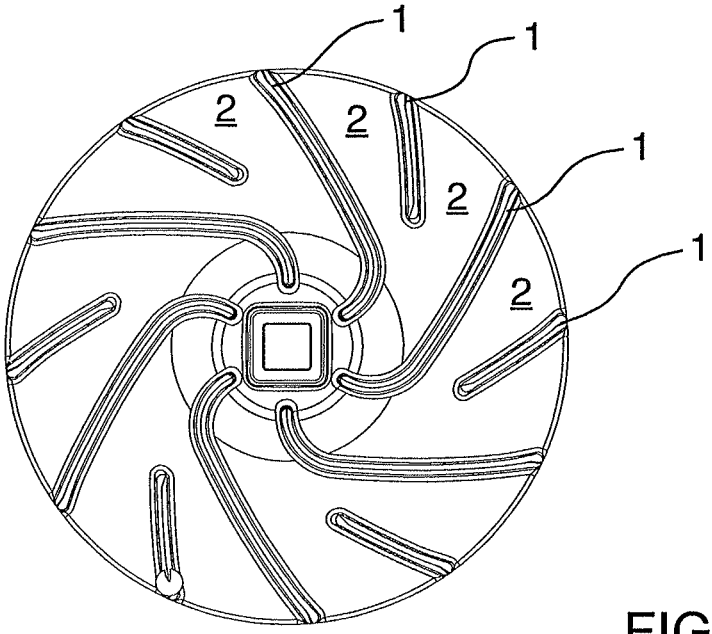
FIG.11 PRIOR ART
FIG. 11 is a top view of the impeller of FIG. 10
Figure 13A:
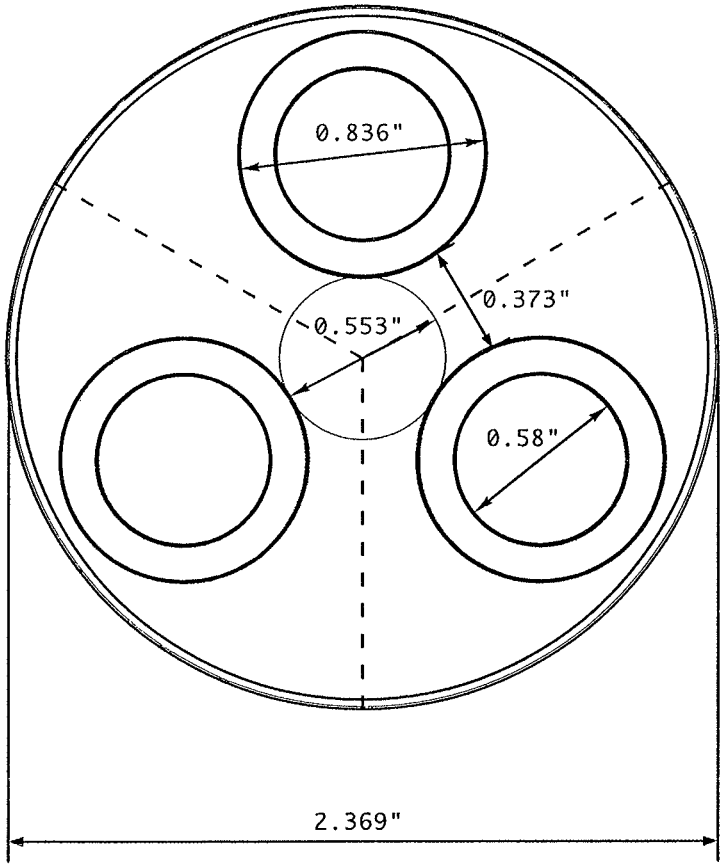
FIG. 13A is a top view of one embodiment of circle geometric figures, with dimensions disclosed for a small pump application.
Figure 13B:
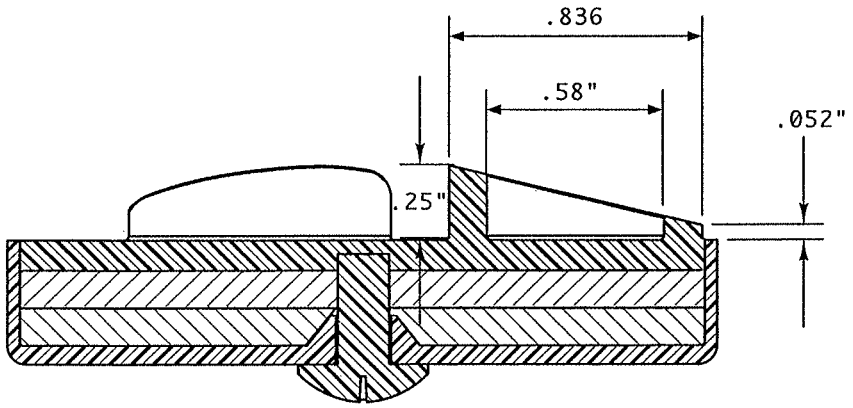
FIG. 13B is a side cross sectional view of the embodiment of FIG. 13A shown dimensions for a particular embodiment.

The pump also has a novel impeller 30. The surface of the generally circular impeller 30 shown in FIG. 1 does not have radial vanes, but instead includes several raised geometric FIG. 11E having areas interior to the perimeter or edge of the geometric figures and disposed on the surface of the impeller 30. The geometric FIG. 11E are offset from the axial center or eye 31 of the impeller surface, leaving a substantially unobstructed eye. As show, the impeller has at least three geometric FIG. 11E (here circles) being equally distributed about a periphery or circumference of the impeller. That is, for the number of figures "n", the circular impeller can be divided into "n" regions (triangular pie shaped areas with the point of the pie at the center) where each region is congruent to every other region (see the three regions dashed depicted in FIG. 13A). Each geometric FIG. 11E has a raised perimeter or edge having a leading portion 11A, opposing a trailing portion 11B, and a proximal portion 11C (closest to the axial center 31), and an interior area 13 between the leading, trailing and proximal portions, where the area interior is at a lower height than the raised perimeter or edge 11. It is preferred that the leading portion 11 A has a curvature that curves away from the direction of rotation, while the trailing portion 11B has a curvature that curves into the direction of rotation (but not required, for instance, if the geometric FIG. 11E resembles a kidney bean shape). Hence, it is preferred that the curvature of the leading portion and trailing portion be opposed. The curvature of the leading and trailing portions are not required to be constant (for instance, an oval shaped figure), nor does the curvature of the leading portion have to match or mirror that of the trailing portion. The proximal portion 11C connects the leading portion and trailing portion to create a substantially continuous perimeter or edge, and preferably is also a curved edge. As shown, the interior area 13 is at a height lower that the edge (here at the height of the surface of the impeller exterior to the figures). Each geometric FIG. 11E is separated from the others, creating channels between the figures. Dimensions of one particular impeller embodiment is shown in FIG. 13.

Figure 1:
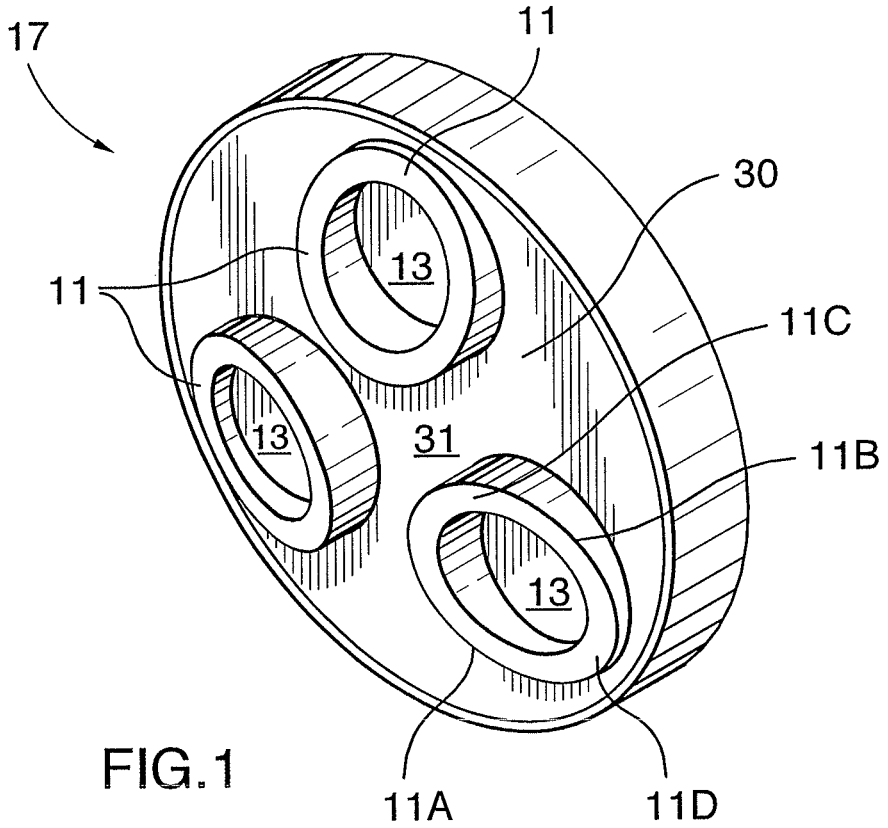
FIG. 1 is a front perspective view of one embodiment of the magnet retainer housing
Figure 2:
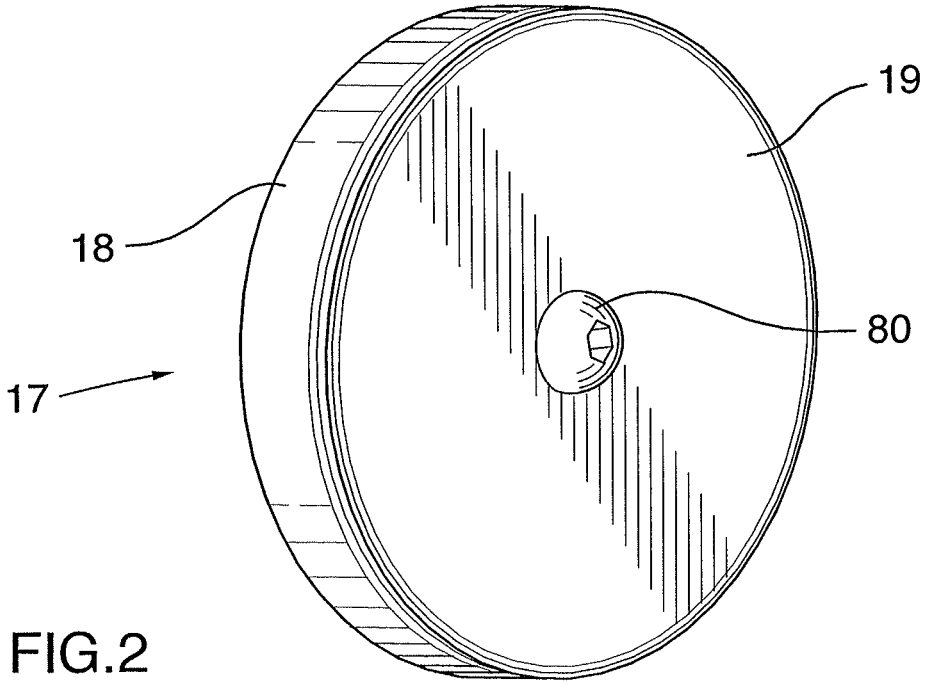
FIG. 2 is a rear perspective view of the embodiment of the magnet retainer housing of FIG. 1

The raised edge 11 may also include a distal portion 11D (closest to the perimeter of the impeller surface and furthest from the impeller center), thereby forming a substantially closed geometric FIG. 11E, such as the circle shaped edge or perimeter shown in FIG. 1. A substantially closed geometric edge 11 is preferred if the pump discharge port(s) face the same direction as the input port(s), as later described. Substantially continuous means that the edge may have minor openings, such as an 1/16-⅛ opening in a ¾ inch diameter circle, as such minor openings do not substantially alter the pumping characteristics of the geometric FIG. 11E (wider openings may be tolerated near the center of the pump, as the fluid velocities are reduced here). Substantially closed means the geometric FIG. 11E has a substantially continuous perimeter and the perimeter generally encloses an area.

Figure 9A:
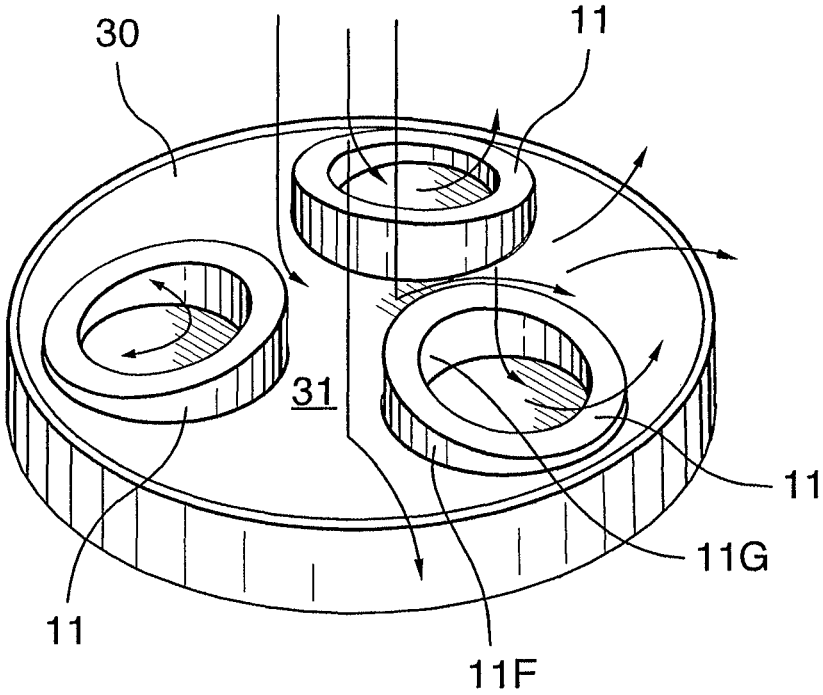
FIG. 9A is a perspective view of one embodiment of the impeller showing fluid flow lines
Figure 9B:
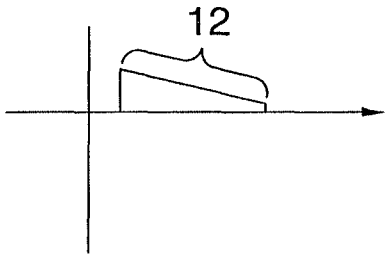
FIG. 9B is a cross section through a geometric figure depicting one embodiment of a sloped region.
Figure 9C:
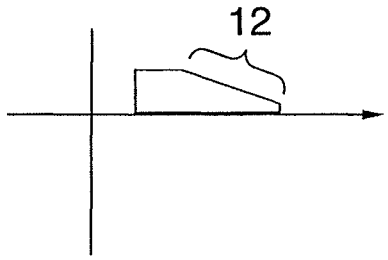
FIG. 9C is a cross section through a geometric figure depicting a second embodiment of a sloped region, with slightly reduced stability.
Figure 9D:
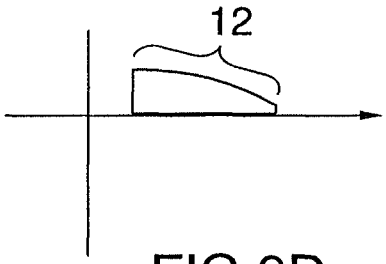
FIG. 9D is a cross section through a geometric figure depicting a third embodiment of a sloped region.
Figure 10:
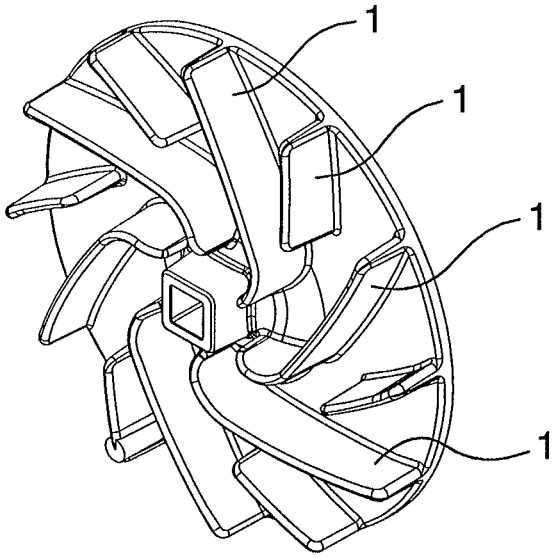
FIG.10 PRIOR ART
FIG. 10 is a perspective view of a prior art vaned impeller

As shown, the raised edge 11 also has a sloped portion 12, where the height of the edge decreases away from the eye 31 or axial center of the impeller surface—that is, the highest portion of the raised edge 11 is closer to the eye 31 of the impeller 30, while the lowest portion is closer to the outer edge of the impeller 30. In other words, the slope decreases from the proximal portion to the distal portion, and it is preferred that the slope decrease monotonically (this allows for flat spots near the distal and proximal portions, or elsewhere if desired). That is, both the leading and proximal portions should slope downwardly (preferably monotonically), but the slopes of the two portions do not have to match, although it is preferred that the leading portion and trailing portion be a mirror image (i.e. match). See FIGS. 9B, 9C and 9D for three slopes for the circles). FIG. 9A shows the figure sloped over the entire figure, with a constant slope; FIG. 9B shows the figure with an initial flat spot near the eye, sloping off thereafter at a constant slope; FIG. 9C shows a varying slope over the entire figure, where shape of the edge approximates log(x) or sqrt (X), (x>1) (another shape would be that represented by the negative sloped surface of 1/x). As shown in FIG. 9C, the sloped portion 12 of the edge does not have to extend over the entire length of the edge. A sloped portion is not required on the raised edge, but is preferred. The height of the leading portion does not need to be a mirror image of that of the trailing portion, although it is preferred. Finally, for a impeller that is tilted in the pumping chamber, it is preferred that the edges of the figures decline in height quickly (such as in FIG. 9A, or where the edge of the figure approximates 1/x for instance). As the geometric figures are above the face of the impeller, the geometric figures, with sufficient tilt to the impeller, could contact or rub against the front interior surface of the pumping chamber, an undesired result. For a shaft driven impeller, where impeller tilt is not possible (unless damaged), the shape represented by FIG. 9D is preferred.

As shown in FIG. 9A, the geometric FIG. 11E are substantially circles, the preferred embodiment, although other curved geometric FIG. 11E could be used. Preferably, geometric FIG. 11E having leading portions and trailing portions with the curvature of these two being opposed, are preferred. Preferably the trailing portion curvature is concave to the direction of rotation, with the leading portion curvature being convex to the direction of rotation (i.e, from the center of the figure, the leading and trialing portions appear concave). For instance, geometric FIG. 11E having teardrop shapes (with the broad part of the teardrop near the eye of the impeller) or wide oval shapes (with the long axis of the oval along a radial line from the center of the impeller) will give certain of the desired flow characteristics provided by circle geometric FIG. 11E. Straight line segmented geometric figures are not preferred as two straight line segments create potential turbulence generated at the intersection or join of two line segments, particularly on the trailing edge.

Figure 7B:
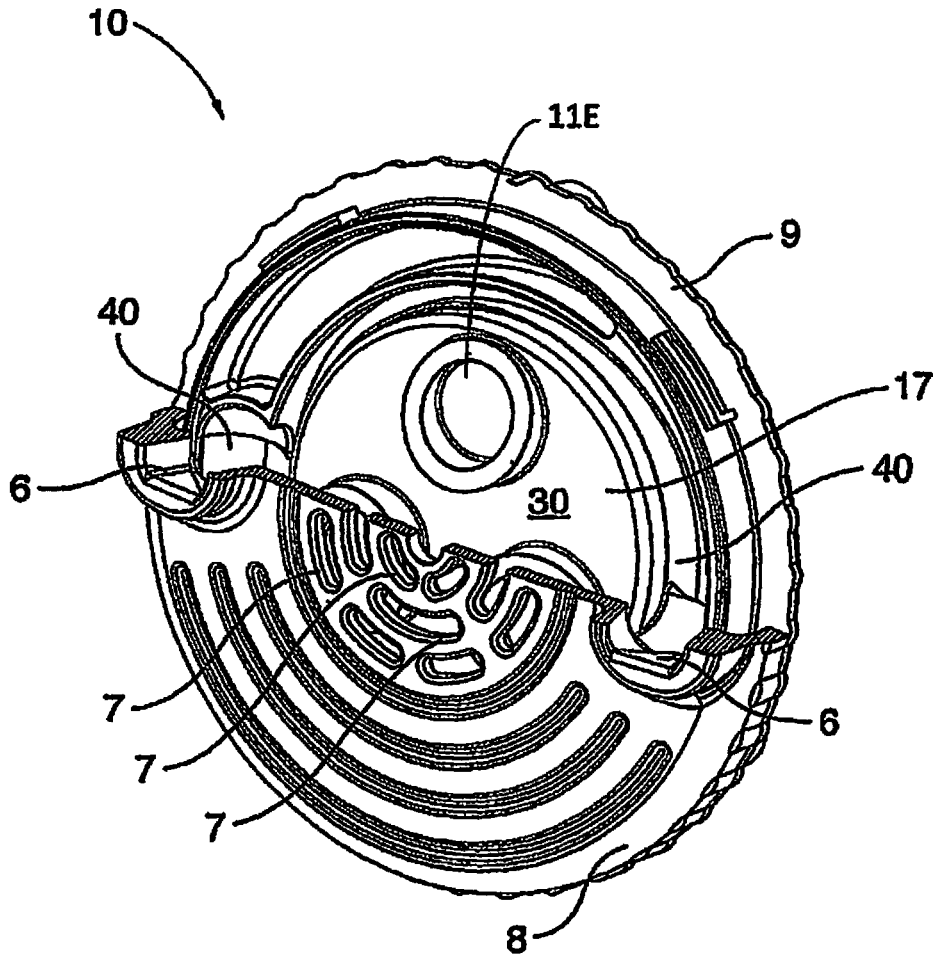
FIG. 7B is a partial cutaway view of the pump body of FIG. 7A
Figure 7C:
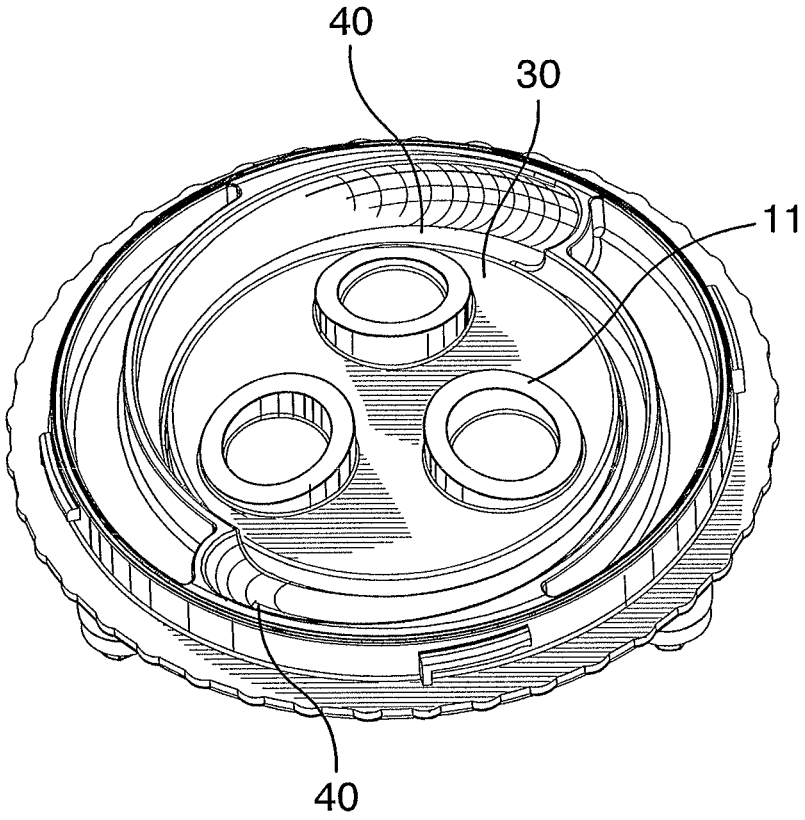
FIG. 7C is a top view of the interior of the pump body of FIG. 7A.
Figure 8:
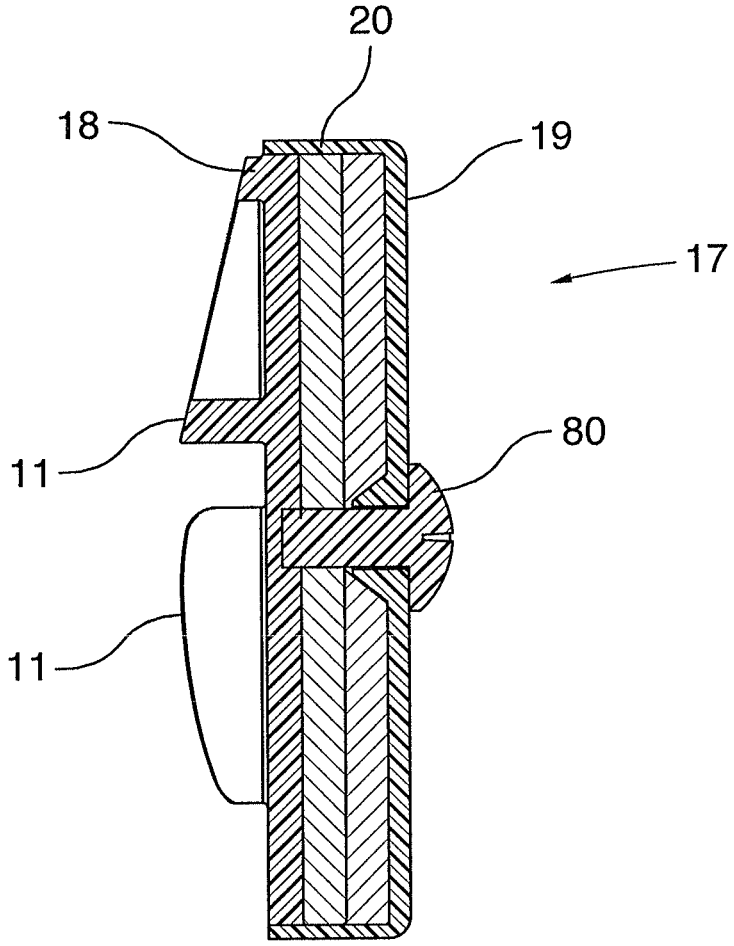
FIG. 8

As shown in the embodiment of FIG. 1, the distal portion 11D of the geometric FIG. 11E is also raised above the impeller surface 30 and the interior area. Water pumped through the interior region 13 of the raised perimeter, when encountering the distal portion 11D, will be given a velocity component perpendicular to the impeller surface. Such a velocity component is preferred when the outlet ports are directed perpendicular to the impeller surface, as in the embodiment shown in FIG. 7A. Also as shown in FIGS. 7C and 7B, the interior face of the rear portion 90 of the pump body 10, has two arcuate volute channels 40 formed adjacent the periphery of the impeller. Each volute channel encompasses about 180 degrees with the widest part of the volute terminating near the outlet ports 6. Each volute thus helps channel fluids exiting the impeller to one of the outlet ports 6.

Flow patterns using circular geometric figures are depicted in FIG. 9A. As shown, fluid is drawn in from the input port(s) into the eye or center region 31 of the impeller by the reduction in pressure near the impeller eye resulting from rotation of the geometric FIG. 11E. The smooth interior face 11G of edge 11 directs water outwardly through the interior region 13 of the geometric FIG. 11E. The velocity of fluid directed outward in the channels between the geometric FIG. 11E is less that that of waters exiting the impeller through the interior of the geometric FIG. 11E, as the discharge area is greater at the channel periphery than it is through the interior of the geometric FIG. 11E. Additionally, the channels are not as efficient as capturing and accelerating fluid as is the concave curvature of the trailing portion of a figure. The pressure differential across the impeller surface having geometric figures (i.e. from the center to the periphery) is not as great as that created by a radially vane impeller, and hence the flow produced by the present impeller is believed to be slower, smoother and less turbulent and more suited for a small applications, such as a spa or aquarium. Additionally, the edge or perimeter forming the rotating figure preferably presents less of a profile (i.e., it is not as high) with distance from the center of the impeller. Hence, the rotating geometric FIG. 11E has less direct fluid contact with fluid away from the impeller eye, providing for smoother discharge of water from the impeller surface. Additionally, this decrease in contact surface area between the rotating impeller and flowing fluid, with distance from the eye, produces less drag on the impeller than would be present without the sloped region. This reduction in drag helps keep the driven pump magnet aligned with the driving motor magnet, which is not subject to any fluid drag force.

Finally, any raised geometric figure on an open rotating impeller will form a bow wave generated by the top edge of the rotating figure. The sloped design of the applicant's geometric figure helps shape a bow wave that is more even and better formed with less turbulence. The bow wave generating figure edge reduces in height with distance from the center of impeller, helping to counter the effects of an increase in velocity of the figure with distance from the impeller center. The impeller is shown on a magnetically driven pump, but it could be used on any pump where low turbulence is desired. That is, the impeller may be adapted to be driven by a motor directly (shaft driven) or indirectly, for instance, magnetically driven.

The invention claimed is:

1. A rotatable pump impeller for use in a centrifugal pump comprising:

an impeller surface;

an axial center on said impeller surface, said impeller adapted for coupling to a rotatable driving means for rotation about said axial center;

at least three geometric figures on said impeller surface, each geometric figure comprising a perimeter, each said perimeter defining closed surface area of said impeller surface interior to said perimeter, said perimeter being raised above said impeller surface and said closed surface area interior to said perimeter, each geometric figure offset from said axial center and offset from and not connected to every other geometric figure.

2. The impeller of claim 1 wherein each said geometric figure perimeter is substantially closed.

3. The pump impeller of claim 2 wherein each perimeter comprises a proximal portion closest to said axial center, a distal portion furthest from said axial center, a trailing portion between said proximal and distal portions clockwise from said proximal portion, and a leading portion of said raised perimeter between said proximal and distal portions clockwise from said distal portion; wherein said leading portion has a first curvature and said trailing portion has a second curvature, and said first and second curvatures are opposed.

4. An impeller according to claim 3 wherein said geometric figure perimeters have a substantially circular configuration.

5. An impeller according to claim 3 wherein said geometric figure perimeters have a substantially teardrop configuration.

6. An impeller according to claim 3 wherein said geometric figure perimeters have a substantially oval configuration.

7. An impeller according to claim 3 wherein each said raised perimeter monotonically decreases from said proximal to the distal portion.

8. The impeller of claim 3 wherein each of said geometric figures are substantially congruent to one another.

9. The impeller of claim 7 wherein each said geometric figures are equally distributed about a perimeter of said impeller.

10. An impeller according to claim 3 wherein said curvature on said trailing portion is a mirror image of the curvature on said leading portion.

11. An impeller according to claim 7 wherein said monotonically decreasing leading portion is a mirror image of said monotonically decreasing trailing portion.

12. An impeller according to claim 1 wherein said impeller is mounted on a shaft through said axial center.

13. An impeller according to claim 1 disposed in a pump housing forming a pump interior, said impeller surface positioned in said pump interior, said pump housing further having an inlet opening and an outlet opening.

14. An impeller according to claim 13 wherein said impeller further has a driven magnet, said driven magnet coupled to said impeller surface.

* * * * *